US011206501B2

(12) United States Patent
Serman et al.

(10) Patent No.: US 11,206,501 B2
(45) Date of Patent: Dec. 21, 2021

(54) METHOD FOR OPERATING A HEARING INSTRUMENT AND A HEARING SYSTEM CONTAINING A HEARING INSTRUMENT

(71) Applicant: SIVANTOS PTE. LTD., Singapore (SG)

(72) Inventors: Maja Serman, Erlangen (DE); Marko Lugger, Weilersbach (DE); Homayoun Kamkar-Parsi, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/654,082

(22) Filed: Oct. 16, 2019

(65) Prior Publication Data

US 2020/0120433 A1 Apr. 16, 2020

(30) Foreign Application Priority Data

Oct. 16, 2018 (EP) ..... 18200843

(51) Int. Cl.
*H04R 25/00* (2006.01)

(52) U.S. Cl.
CPC ..... *H04R 25/70* (2013.01); *H04R 25/453* (2013.01); *H04R 25/50* (2013.01); *H04R 25/552* (2013.01); *H04R 25/558* (2013.01); *H04R 2225/021* (2013.01); *H04R 2225/025* (2013.01)

(58) Field of Classification Search
CPC . H04S 7/00; H04S 7/302; H04S 7/303; H04S 7/304; H04S 2400/13; H04R 5/04; H04R 2225/43; H04R 2225/41; H04R 2460/01; H04R 2460/07; G10K 11/175; G10K 11/1752; G10K 2210/108; G10K 2210/1081; G10K 2210/1082
See application file for complete search history.

(56) References Cited

U.S. PATENT DOCUMENTS

| | | | | |
|---|---|---|---|---|
| 8,897,437 | B1 | 11/2014 | Tan et al. | |
| 2016/0373869 | A1* | 12/2016 | Gran | H04R 25/70 |
| 2018/0125415 | A1* | 5/2018 | Reed | H04R 25/30 |
| 2019/0110135 | A1* | 4/2019 | Jensen | H04R 25/505 |

* cited by examiner

*Primary Examiner* — Walter F Briney, III
(74) *Attorney, Agent, or Firm* — Laurence A. Greenberg; Werner H. Stemer; Ralph E. Locher

(57) ABSTRACT

A method operates a hearing instrument that is worn in or at the ear of a user. The method includes capturing a sound signal from an environment of the hearing instrument; analyzing the captured sound signal to recognize own-voice intervals, in which the user speaks, and foreign-voice intervals, in which at least one different speaker speaks; and determining, from the recognized own-voice intervals and foreign-voice intervals, at least one turn-taking feature. From the at least one turn-taking feature a measure of the sound perception by the user is derived. Predefined action for improving the sound perception is taken if the measure or the at least one turn-taking feature fulfill a predefined criterion.

17 Claims, 3 Drawing Sheets

METHOD FOR OPERATING A HEARING INSTRUMENT AND A HEARING SYSTEM CONTAINING A HEARING INSTRUMENT

CROSS-REFERENCE TO RELATED APPLICATION

This application claims the benefit, under 35 U.S.C. § 119, of European patent application EP 18 200 843.3, filed Oct. 16, 2018; the prior application is herewith incorporated by reference in its entirety.

BACKGROUND OF THE INVENTION

Field of the Invention

The invention relates to a method for operating a hearing instrument. The invention further relates to a hearing system containing a hearing instrument.

A hearing instrument is an electronic device being configured to support the hearing of a person wearing it (which person is called the user or wearer of the hearing instrument). A hearing instrument may be specifically configured to compensate for a hearing loss of a hearing-impaired user. Such hearing instruments include hearing aids. Other hearing instruments are configured to fit the needs of normal hearing persons in special situations, e.g. sound-reducing hearing instruments for musicians, etc.

Hearing instruments are typically configured to be worn at or in the ear of the user, e.g. as a behind-the-ear (BTE) or in-the-ear (ITE) device. With respect to its internal structure, a hearing instrument normally has an (acousto-electrical) input transducer, a signal processor and an output transducer. During operation of the hearing instrument, the input transducer captures a sound signal from an environment of the hearing instrument and converts it into an input audio signal (i.e. an electrical signal transporting a sound information). In the signal processor, the input audio signal is processed, in particular amplified dependent on frequency. The signal processor outputs the processed signal (also called output audio signal) to the output transducer. Most often, the output transducer is an electro-acoustic transducer (also called "receiver") that converts the output audio signal into a processed sound signal to be emitted into the ear canal of the user.

The term "hearing system" denotes an assembly of devices and/or other structures providing functions required for the normal operation of a hearing instrument. A hearing system may consist of a single stand-alone hearing instrument. As an alternative, a hearing system may comprise a hearing instrument and at least one further electronic device which may be, e.g., one of another hearing instrument for the other ear of the user, a remote control and a programming tool for the hearing instrument. Moreover, modern hearing systems often comprise a hearing instrument and a software application for controlling and/or programming the hearing instrument, which software application is or can be installed on a computer or a mobile communication device such as a mobile phone. In the latter case, typically, the computer or the mobile communication device is not a part of the hearing system. In particular, most often, the computer or the mobile communication device will be manufactured and sold independently of the hearing system.

The adaptation of a hearing instrument to the needs of an individual user is a difficult task, due to the diversity of the objective and subjective factors that influence the sound perception by a user, the complexity of acoustic situations in real life and the large number of parameters that influence signal processing in a modern hearing instrument. Assessment of the quality of sound perception by the user wearing the hearing instrument and, thus, benefit of the hearing instrument to the individual user is a key factor for the success of the adaptation process.

So far, the benefit of hearing instruments is expressed through objective measurements (e.g. speech-in-noise understanding performance is measured) or through evaluation of the subjective user satisfaction (e.g. assessed via spoken or written questionnaires or interviews). However both methods do not precisely reflect the benefit of a hearing instrument in real life as they are normally performed in a laboratory or after a home trial. Currently, there is no objective measure of hearing instrument benefit (i.e. sound perception) in real life, since neither the interaction with other people nor the acoustic environment can be controlled and measured in real life.

SUMMARY OF THE INVENTION

An object of the present invention is to provide a method for operating a hearing instrument being worn in or at the ear of a user which method allows for precise assessment of the sound perception by the user wearing the hearing instrument in real life situations and, thus, of the benefit of the hearing instrument to the user.

Another object of the present invention is to provide a hearing system containing a hearing instrument to be worn in or at the ear of a user which system allows for precise assessment of the sound perception by the user wearing the hearing instrument in real life situations and, thus, of the benefit of the hearing instrument to the user.

According to a first aspect of the invention, a method for operating a hearing instrument that is worn in or at the ear of a user is provided. The method includes capturing a sound signal from an environment of the hearing instrument and analyzing the captured sound signal to recognize own-voice intervals, in which the user speaks, and foreign-voice intervals, in which a different speaker speaks. From the recognized own-voice intervals and foreign-voice intervals, respectively, at least one turn-taking feature is determined. From the at least one turn-taking feature a measure of the sound perception by the user is derived.

"Turn-taking" denotes the human-specific organization of a conversation in such a way that the discourse between two or more people is organized in time by means of explicit phrasing, intonation and pausing. The key mechanism in the organization of turns, i.e. the contributions of different speakers, in a conversation is the ability to anticipate or project the moment of completion of a current speaker's turn. Turn-taking is characterized by different features, as will be explained in the following, such as overlaps, lapses, switches and pauses.

On the one hand, the present invention is based on the finding that the characteristics of turn-taking in a given conversation yield a strong clue to the emotional state of the speakers, see e.g. S. A. Chowdhury, et al. "Predicting User Satisfaction from Turn-Taking in Spoken Conversations", Interspeech 2016.

On the other hand, the present invention is based on the experience that, in many situations, the emotional state of a hearing instrument user is strongly correlated with the sound perception by the user. Thus, the turn-taking in a conversation in which hearing instrument user is involved, is found to be a source of information from which the sound perception by the user can be assessed in an indirect yet precise manner.

The "measure" (or estimate) of the sound perception by the user is an information characterizing the quality or valence of the sound perception, i.e. an information characterizing how good, as derived from the turn-taking features, the user wearing the hearing instrument perceives the captured and processed sound. In simple yet effective embodiments of the invention, the measure is configured to characterize the sound perception in a quantitative manner. In particular, the measure may be provided as a numeric variable, the value of which may vary between a minimum (e.g. "0" corresponding to a very poor sound perception) and a maximum (e.g. "10" corresponding to a very good sound perception). In other embodiments of the invention, the measure is configured to characterize the sound perception and, thus, the emotional state of the user in a qualitative manner. E.g. the measure may be provided as a variable that may assume different values corresponding to "active participation", "stress", "fatigue", "passivity", etc. In more differentiated embodiments of the invention, the measure may be configured to characterize the sound perception or emotional state of the user in a both qualitative and quantitative manner. For instance, the measure may be provided as a vector or array having a plurality of elements corresponding, e.g., to "activity/passivity", "listening effort", etc., where each of the elements may assume different values between a respective minimum and a respective maximum.

In preferred embodiments of the invention, the at least one turn-taking feature is selected from one of:

a) the temporal length or the temporal occurrence of turns of the user and/or the temporal length or the temporal occurrence of turns of the different speaker; wherein a "turn" is a temporal interval in which the user or the different speaker speak without a pause, while the or each interlocutor is silent;

b) the temporal length or the temporal occurrence of pauses, wherein a "pause" is an interval without any speech separating two consecutive turns of the user or two consecutive turns of the same different speaker, if the temporal length of this interval without speech exceeds a predefined threshold; optionally, pauses between two turns of the user and pauses between two turns of the different speaker are evaluated separately;

c) the temporal length or the temporal occurrence of lapses, wherein a "lapse" is an interval without any speech separating a turn of the different speaker and a consecutive turn of the user or separating a turn of the user and a consecutive turn of the different speaker, if the temporal length of this interval without speech exceeds a predefined threshold; optionally, lapses between a turn of the user and a consecutive turn of the different speaker and lapses between a turn of the different speaker and a consecutive turn of the user are evaluated separately;

d) the temporal length or the temporal occurrence of overlaps, wherein an "overlap" is an interval in which both the user and the different speaker speak; optionally, such an interval is considered an "overlap" only, if the temporal length of this interval exceeds a predefined threshold; also optionally, overlaps between a turn of the user and a consecutive turn of the different speaker and overlaps between a turn of the different speaker and a consecutive turn of the user are evaluated separately; and e) the temporal occurrence of switches, wherein a "switch" is a transition from a turn of the different speaker to a consecutive turn of the user or from a turn of the user to a consecutive turn of the different speaker within a predefined temporal threshold; optionally, the temporal threshold are defined so to speech negative transition times to allow short periods of overlapping to be counted as switches; also optionally, switches between a turn of the user and a consecutive turn of the different speaker and switches between a turn of the different speaker and a consecutive turn of the user are evaluated separately.

The at least one turn-taking feature may also be selected from a (mathematical) combination of a plurality of the turn-taking features mentioned above, e.g.

the relation (i.e. the quotient) of the temporal lengths of turns of the user and the different speaker, respectively; this relation is indicative of the activity or passivity of the user in a conversation;

the relation of the temporal occurrence of lapses between a turn of the different speaker and a consecutive turn of the user and the temporal occurrence of turns of the user; this relation indicates the portion or percentage of turns of the different speaker, to which the user fails to react promptly and, thus, is indicative of the quality of speech intelligibility of the user;

the relation of the temporal occurrence of overlaps between a turn of the different speaker and a consecutive turn of the user and the temporal occurrence of turns of the user; this relation indicates the portion or percentage of turns of the different speaker, which are interrupted by the user and, thus, is indicative of a general emotional state (such as a degree of patience/impatience or stress level) of the user.

The term "temporal occurrence", as used above, denotes the statistical frequency with which the respective turn-taking feature (i.e. turns, pauses, lapses, overlaps or switches) occurs, e.g. the number of turns, pauses, lapses, overlaps or switches, respectively, per minute. Alternatively, the "temporal occurrence" may be expressed in terms of the average time interval between two consecutive pauses, lapses, overlaps or switches, respectively. Preferably, the terms "temporal length" and "temporal occurrence" are determined as averaged values.

The thresholds mentioned above may be selected individually (and thus differently) for pauses, lapses, overlaps and switches. However, in a preferred embodiment, all the thresholds are set to the same value, e.g. 0.5 sec. In the latter case, a gap of silence between a turn of the user and a consecutive turn of the different speaker is considered a switch if its temporal length is smaller than 0.5 sec; and it is considered a lapse if its temporal length exceeds 0.5 sec.

According to the invention, the measure is used to actively improve the sound perception by the user. To this end, the measure of the sound perception is tested with respect to a predefined criterion indicative of a poor sound perception; e.g. the measure may be compared with a predefined threshold. If the criterion is fulfilled (e.g. if the threshold is exceeded or undershot, depending on the definition of the measure), a predefined action for improving the sound perception is performed.

Additionally, as an option, the measure of the sound perception may be recorded for later use, e.g. as a part of a data logging function, or be provided to the user.

In some embodiments of the invention, the action for improving the sound perception contains automatically creating and outputting a feedback to the user by means of the hearing instrument and/or an electronic communication device linked with the hearing instrument for data exchange, the feedback indicating a poor sound perception. Such feedback helps improving the sound the perception by drawing the user's attention to the problem that may not be aware to him, thus allowing the user to take appropriate actions such as approaching nearer to the different speaker, manually adjusting the volume of the hearing instrument or asking the different speaker to speak more slowly. Additionally or alternatively, in particular if a poor sound perception is found to occur frequently or to persist for a longer period of time, a feedback may be output suggesting the user to visit an audio care professional.

In a more enhanced embodiment of the invention, the action for improving the sound perception contains automatically altering at least one parameter of a signal processing of the hearing instrument. For instance, the noise reduction and/or the directionality of the hearing aid may be increased, if said criterion is found to be fulfilled.

In preferred embodiments of the invention, the measure of the sound perception is not only derived from the at least one turn-taking feature alone. Instead, the measure is determined in further dependence of at least one information being selected from at least one acoustic feature of the own voice of the user and/or at least one environmental acoustic feature as detailed below.

To this end, during recognized own-voice intervals, the captured sound signal may be analyzed for at least one of the following acoustic features of the own voice of the user:

a) the voice level (i.e. the volume or sound intensity of the captured sound signal, from which, optionally, noise may have been subtracted before);
b) the formant frequencies;
c) the pitch frequency (fundamental frequency);
d) the frequency distribution; and
e) the speed of speech.

Instead of at least one acoustic feature of the own voice of the user, a temporal variation (e.g. a derivative, trend, etc.) of this feature may be used for determining the measure of the sound perception.

Additionally or alternatively, the captured sound signal is analyzed for at least one of the following environmental acoustic features:

a) the sound level of the captured sound signal;
b) the signal-to-noise ratio;
c) the reverberation time;
d) the number of different speakers (which number may include "1"); and
e) the direction of the different speaker (or the directions of the different speakers, if applicable).

Preferably, the whole captured sound signal (including turns of the user, turns of the at least one different speaker, overlaps, pauses and lapses) is analyzed for the at least one environmental acoustic feature. Instead of at least one environmental acoustic feature, a temporal variation (i.e. a derivative, trend, etc.) of this feature may be used for determining the measure of the sound perception.

In preferred embodiments of the invention, the determination of the measure of the sound perception (in dependence of the at least one turn-taking feature and, optionally, the at least one acoustic feature of the own voice of the user and/or the at least one environmental acoustic feature) is further based on at least one of:

a) predetermined reference values of the at least one turn-taking feature (and, optionally, the at least one acoustic feature of the own voice of the user) in quiet; such reference values may be acquired, e.g. by machine-learning, in a training step preceding the normal operation of the hearing instrument);
b) audiogram values representing a hearing ability of the user;
c) at least one uncomfortable level of the user; and
d) information concerning an environmental noise sensitivity and/or distractibility of the user; such information may be entered by the user or a audio care professional.

In preferred embodiments of the invention, the measure may be determined using a mathematical function that is parameterized by at least one of the predetermined reference values, audiogram values, uncomfortable level and information concerning an environmental noise sensitivity and/or distractibility of the user. In another embodiment of the invention, a decision chain or tree (in particular a structure of IF-THEN-ELSE clauses) or a neural network is used to determine the measure.

In a favored embodiment, the measure of the sound perception is derived from a combination of:

a) at least one turn-taking feature, e.g. at least one of
b) the average temporal length of turns of the user in relation to the average temporal length of turns of the different speaker,
c) the average temporal occurrence of lapses between a turn of the different speaker and a consecutive turn of the user in relation to the average temporal occurrence of turns of the user;
d) the average temporal occurrence of overlaps between a turn of the different speaker and a consecutive turn of the user in relation to the average temporal occurrence of turns of the user;
e) at least one acoustic feature of the own voice of the user, e.g. the pitch frequency; and
f) at least one environmental acoustic feature, e.g. the signal-to-noise ratio.

Preferably, in order to determine the measure of the sound perception, each of the above mentioned quantities, i.e. the at least one turn-taking feature, the at least one acoustic feature and at least one environmental acoustic feature, is compared to a respective reference value. E.g., the measure of the sound perception may be derived from the differences of the above mentioned quantities and their respective reference values. Preferably, the above mentioned reference values are derived by analyzing the captured sound signal during a training period (in which, e.g., the user speaks with a different person in a quiet environment). Alternatively, at least one of the reference values may be pre-determined by the manufacturer of the hearing system or by an audiologist.

According to a second aspect of the invention, a method for operating a hearing instrument that is worn in or at the ear of a user is provided. The method contains capturing a sound signal from an environment of the hearing instrument and analyzing the captured sound signal to recognize own-voice intervals, in which the user speaks, and foreign-voice intervals, in which a different speaker speaks. From the recognized own-voice intervals and foreign-voice intervals, respectively, at least one turn-taking feature (in particular at least one of the turn-taking features mentioned above) is determined. The at least one turn-taking feature is tested with respect to a predefined criterion indicative of a poor sound perception; e.g. the at least one turn-taking feature may be compared with a predefined threshold. If the criterion is found to be fulfilled (e.g. if the threshold is exceeded or undershot, depending on the definition of the turn-taking feature and the threshold), a predefined action for improving the sound perception (e.g. one of the actions specified above) is performed.

The method according to the second aspect of the invention corresponds to the method according to the first aspect of the invention except for the fact that the measure of the sound perception is not explicitly determined. Instead, the action for improving the sound perception is directly derived from an analysis of the at least one turn-taking feature. However, all variants and optional features of the according to the first aspect of the invention may be applied, mutatis mutandis, to the method according to the second aspect of the invention.

In particular, the captured sound signal may be analyzed for at least one of the own-voice acoustic features as specified above and/or at least one of the environmental acoustic features as specified above. In this case, the criterion is defined in further dependence of the at least one own-voice acoustic feature and/or the at least on environmental acoustic feature. Also, the criterion may depend on predetermined reference values, audiogram values, uncomfortable level and information concerning an environmental noise sensitivity and/or distractibility of the user, as specified above. In a favored embodiment, the criterion is based on a combination of at least one turn-taking feature, as specified above, at least one acoustic feature of the own voice of the user, e.g. the pitch frequency, and at least one environmental acoustic feature, e.g. the signal-to-noise ratio. The criterion may comprise comparing each of the above mentioned quantities, i.e. the at least one turn-taking feature, the at least one acoustic feature and at least one environmental acoustic feature, to a respective reference value as mentioned above.

According to a third aspect of the invention, a hearing system with a hearing instrument to be worn in or at the ear of a user is provided. The hearing instrument contains an input transducer arranged to capture a sound signal from an environment of the hearing instrument, a signal processor arranged to process the captured sound signal, and an output transducer arranged to emit a processed sound signal into an ear of the user. In particular, the input transducer converts the sound signal into an input audio signal that is fed to the signal processor, and the signal processor outputs an output audio signal to the output transducer which converts the output audio signal into the processed sound signal. Generally, the hearing system is configured to automatically perform the method according to the first aspect of the invention (or a preferred embodiment or variant thereof). To this end, the system contains a voice recognition unit that is configured to analyze the captured sound signal to recognize own-voice intervals, in which the user speaks, and foreign-voice intervals, in which a different speaker speaks. The system further contains a control unit that is configured to determine, from the recognized own-voice intervals and foreign-voice intervals, at least one turn-taking feature, and to derive from the at least one turn-taking feature a measure of the sound perception by the user.

According to a fourth aspect of the invention, a hearing system with a hearing instrument to be worn in or at the ear of a user is provided. The hearing instrument contains an input transducer, a signal processor and an output transducer as specified above. Herein, the system is configured to automatically perform the method according to the second aspect of the invention (or a preferred embodiment or variant thereof). In particular, the system contains a voice recognition unit that is configured to analyze the captured sound signal to recognize own-voice intervals, in which the user speaks, and foreign-voice intervals, in which a different speaker speaks. The system further contains a control unit that is configured to determine, from the recognized own-voice intervals and foreign-voice intervals, at least one turn-taking feature, to test the at least one turn-taking feature with respect to a predefined criterion indicative of a poor sound perception, and to take a predefined action for improving the sound perception if the criterion is found to be fulfilled.

Preferably, the signal processor according to the third and fourth aspect of the invention is configured as a digital electronic device. It may be a single unit or consist of a plurality of sub-processors. The signal processor or at least one of the sub-processors may be a programmable device (e.g. a microcontroller). In this case, the functionality mentioned above or part of said functionality may be implemented as software (in particular firmware). Also, the signal processor or at least one of the sub-processors may be a non-programmable device (e.g. an ASIC). In this case, the functionality mentioned above or part of the functionality may be implemented as hardware circuitry.

In a preferred embodiment of the invention, the voice recognition unit according to the third and fourth aspect of the invention is arranged in the hearing instrument. In particular, it may be a hardware or software component of the signal processor. In a preferred embodiment, it contains a voice detection (VD) module for general voice activity detection and an own voice detection (OVD) module for detection of the user's own voice. However, in other embodiments of the invention, the voice recognition unit or at least a functional part thereof may be located on an external electronic device. For instance, the voice recognition unit may contain a software component for recognizing a foreign voice (i.e. a voice of a speaker different from the user) that may be implemented as a part of a software application to be installed on an external communication device (e.g. a computer, a smartphone, etc.).

The control unit according to the third and fourth aspect of the invention may be arranged in the hearing instrument, e.g. as a hardware or software component of the signal processor. However, preferably, the control unit is arranged as a part of a software application to be installed on an external communication device (e.g. a computer, a smartphone, etc.).

Finally, a further aspect of the invention relates to the use of at least one turn-taking feature (as specified above) determined from recognized own-voice intervals and foreign-voice intervals of a sound signal captured by a hearing instrument from an environment thereof to determine a measure of the sound perception by a user of the hearing instrument and/or to take a predefined action for improving the sound perception.

Other features which are considered as characteristic for the invention are set forth in the appended claims.

Although the invention is illustrated and described herein as embodied in a method for operating a hearing instrument and a hearing system comprising a hearing instrument it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
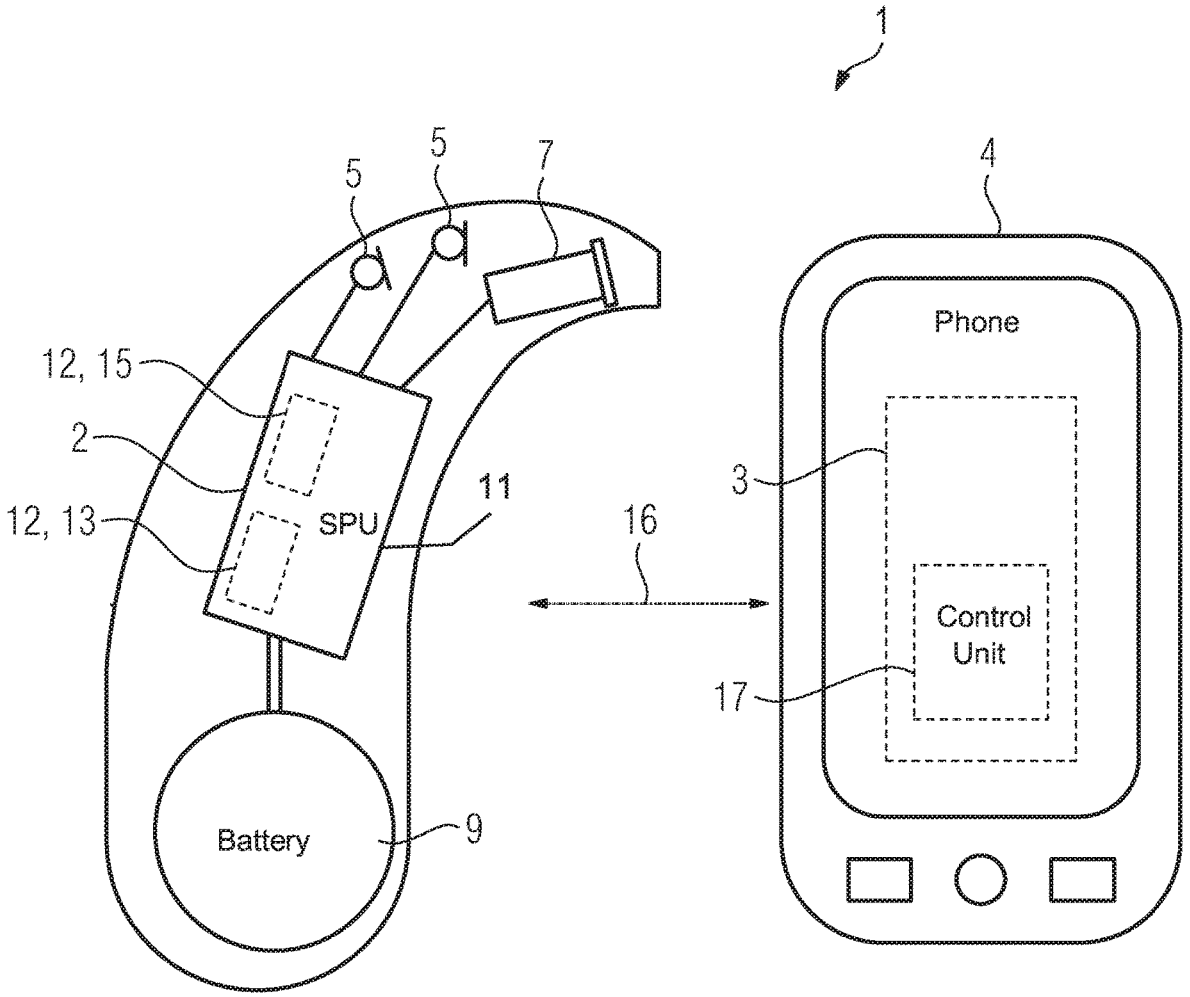
FIG. 1 is a schematic representation of a hearing system having a hearing aid to be worn in or at an ear of a user and a software application for controlling and programming the hearing aid, the software application being installed on a smartphone.

In the figures, like reference numerals indicate like parts, structures and elements unless otherwise indicated.

Referring now to the figures of the drawings in detail and first, particularly to FIG. 1 thereof, there is shown a hearing system 1 having a hearing aid 2, i.e. a hearing instrument being configured to support the hearing of a hearing impaired user, and a software application (subsequently denoted "hearing app" 3), that is installed on a smartphone 4 of the user. Here, the smartphone 4 is not a part of the system 1. Instead, it is only used by the system 1 as a resource providing computing power and memory. Generally, the hearing aid 2 is configured to be worn in or at one of the ears of the user. As shown in FIG. 1, the hearing aid 2 may be configured as a behind-the-ear (BTE) hearing aid. Optionally, the system 1 contains a second hearing aid (not shown) to be worn in or at the other ear of the user to provide binaural support to the user.

The hearing aid 2 contains two microphones 5 as input transducers and a receiver 7 as output transducer. The hearing aid 2 further contains a battery 9 and a signal processor 11. Preferably, the signal processor 11 contains both a programmable sub-unit (such as a microprocessor) and a non-programmable sub-unit (such as an ASIC). The signal processor 11 includes a voice recognition unit 12, that contains a voice detection (VD) module 13 and an own voice detection (OVD) module 15. By preference, both modules 13 and 15 are configured as software components being installed in the signal processor 11.

During operation of the hearing aid 2, the microphones 5 capture a sound signal from an environment of the hearing aid 2. Each one of the microphones 5 converts the captured sound signal into a respective input audio signal that is fed to the signal processor 11. The signal processor 11 processes the input audio signals of the microphones 5, i.a., to provide a directed sound information (beam-forming), to perform noise reduction and to individually amplify different spectral portions of the audio signal based on audiogram data of the user to compensate for the user-specific hearing loss. The signal processor 11 emits an output audio signal to the receiver 7. The receiver 7 converts the output audio signal into a processed sound signal that is emitted into the ear canal of the user.

The VD module 13 generally detects the presence of voice (independent of a specific speaker) in the captured audio signal, whereas the OVD module 15 specifically detects the presence of the user's own voice. By preference, modules 13 and 15 apply technologies of VD (also called speech activity detection, VAD) and OVD, that are as such known in the art, e.g. from U.S. patent publication No. 2013/0148829 A1 or international patent disclosure WO 2016/078786 A1.

The hearing aid 2 and the hearing app 3 exchange data via a wireless link 16, e.g. based on the Bluetooth standard. To this end, the hearing app 3 accesses a wireless transceiver (not shown) of the smartphone 4, in particular a Bluetooth transceiver, to send data to the hearing aid 2 and to receive data from the hearing aid 2. In particular, during operation of the hearing aid 2, the VD module 13 sends signals indicating the detection or non-detection of general voice activity to the hearing app 3. In a preferred embodiment, the VD module 13 provides spatial information concerning detected voice activity, i.e. information on the direction or directions in which voice activity is detected. In order to derive such spatial information, the VD module 13 separately analyzes the signal of different beam formers. On the other hand, the OVD module 15 sends signals indicating the detection or non-detection of own voice activity to the hearing app 3.

Own-voice intervals, in which the user speaks, and foreign-voice intervals, in which at least one different speaker speaks, are derived from the signals of VD module 13 and the signals of the OVD module 15. As, in the preferred embodiment, the signal of the VD module 13 contains a spatial information, different speakers can be distinguished from each other. Using this spatial information, the hearing aid 2 or the hearing app 3 derives information on the number of speakers speaking in the same own-voice interval or foreign-voice interval. Moreover, using the spatial information provided by the VD module 13 and the signal of the OVD module 15, the hearing aid 2 or the hearing app 3 recognize overlaps in which the user and the at least one different speaker speak simultaneously.

The hearing app 3 includes a control unit 17 that is configured to derive at least one of the turn-taking features specified above, from the own-voice intervals and foreign-voice intervals. In a preferred example, the control unit 17 derives from the own-voice intervals, foreign-voice intervals and overlaps:

a) the relation $T_{TU}/T_{TS}$ of the average temporal length $T_{TU}$ of turns of the user and the average temporal length $T_{TS}$ of turns of the different speaker;

b) the relation $h_{LU}/h_{TU}$ of the average temporal occurrence $h_{LU}$ of lapses (i.e. the average number of lapses per minute) between a turn of the different speaker and a consecutive turn of the user and the average temporal occurrence $h_{TU}$ of turns of the user; and c) the relation $h_{OU}/h_{TU}$ of the average temporal occurrence $h_{OU}$ of overlaps (i.e. the average number of overlaps per minute) between a turn of the different speaker and a consecutive turn of the user and the average temporal occurrence $h_{TU}$ of turns of the user.

The control unit 17 combines the above mentioned turn-taking features in a variable which, subsequently, is denoted the turn-taking behavior TT. The turn-taking behaviour TT may be represented by a vector ($TT=\{T_{TU}/T_{TS};\ h_{LU}/h_{TU};\ h_{OU}/h_{TU}\}$).

Moreover, the control unit 17 may receive from the signal processor 11 of the hearing aid 2 at least one of the acoustic features of the own voice of the user specified above. In the preferred example, the control unit 17 receives values of the pitch frequency F of the user's own voice, measured by the signal processor 11 during own-voice intervals.

Finally, the control unit 17 may receive from the signal processor 11 of the hearing aid 2 at least one of the environmental acoustic features specified above. In the preferred example, the control unit 17 receives measured values of the general sound level L (i.e. volume) of the captured sound signal.

Taking into account the information specified above, in particular the turn-taking behavior TT, pitch frequency F and sound level L, the control unit 17 decides whether or not to automatically take at least one predefined action to improve the sound perception by the user.

As will be explained in the following, this decision is based on:

a) a predetermined reference value $TT_{ref}$ of the turn-taking behavior TT;

b) a predetermined reference value $F_{ref}$ of the pitch frequency F of the user's own voice; and c) a predefined threshold $L_T$ of the sound level L of the captured audio signal.

The reference values $TT_{ref}$ and $F_{ref}$ are determined by analyzing the turn-taking behavior TT and pitch frequency F of the user's own voice when speaking to a different speaker in a quiet environment, during a training period preceding the real life use of the hearing system 1. Preferably, the threshold value $L_T$ is pre-set by the manufacturer of the system 1.

In detail, the system 1 automatically performs the method as described hereafter.

In a first step 20, preceding the real life use of the hearing aid 2, the control unit 17 starts a training period of, e.g. ca. 5 min, during which the control unit 17 determines the reference values $TT_{ref}$ ($TT_{ref}=\{[T_{TU}/T_{TS}]_{ref}; [h_{LU}/h_{TU}]_{ref}; [h_{OU}/h_{TU}]_{ref}\}$) and $F_{ref}$. The reference values $TT_{ref}$ and $F_{ref}$ are determined by averaging over values of the turn-taking behavior TT and the pitch frequency F that have been recorded by the signal processor 11 and the control unit 17 during the training period.

The step 20 is started on request of the user. Upon start of the training period, the control unit 17 informs the user, e.g. by a text message output via a display of the smartphone 4, that the training period is to be performed during a conversation in quiet. After having determined the reference values $TT_{ref}$ and $F_{ref}$, the control unit 17 persistently stores the reference values $TT_{ref}$ and $F_{ref}$ in the memory of the smartphone 4.

In the real life use of the hearing aid 2, in a step 22 during a conversation of the user with a different speaker (i.e. a person different from the user), the control unit 17 triggers the signal processor 11 to track the own-voice intervals, foreign-voice intervals, the pitch frequency F of the user's own voice and the sound level L of the captured audio signal for a given time interval (e.g. 3 minutes). The control unit 17 temporarily stores the tracked data in the memory of the smartphone 4. The control unit 17 may be configured to automatically recognize a communication by a frequent alternation between own-voice intervals and foreign-voice intervals in the captured sound signal.

In a subsequent step 24, the control unit 17 derives the turn-taking behavior TT, i.e. the relations $T_{TU}/T_{TS}$, $h_{LU}/h_{TU}$ and $h_{OU}/h_{TU}$, from an analysis of the tracked own-voice intervals and foreign-voice intervals.

In order to make a decision, whether or not to take an action for improving the sound perception by the user, the control unit 17 uses a criterion that is defined as a three-step decision chain.

In a step 26, the control unit 17 tests whether the deviation $|TT-TT_{ref}|$ of the turn-taking behavior TT, as determined in step 24, from the reference value $TT_{ref}$ exceeds a predetermined threshold $\Delta_{TT}$ ($|TT-TT_{ref}|>\Delta_{TT}$). E.g., the deviation $|TT-TT_{ref}|$ may be expressed in terms of the vector distance (Euclidian distance) between TT and $TT_{ref}$:

a) eq. 1

$$\sqrt{\left(\frac{T_{TU}}{T_{TS}}-\left[\frac{T_{TU}}{T_{TS}}\right]_{ref}\right)^2+\left(\frac{h_{LU}}{h_{TU}}-\left[\frac{h_{LU}}{h_{TU}}\right]_{ref}\right)^2+\left(\frac{h_{OU}}{h_{TU}}-\left[\frac{h_{OU}}{h_{TU}}\right]_{ref}\right)^2} > \Delta_{TT}$$

If above condition is found to be fulfilled (Y), i.e. if the turn-taking behavior TT is found to strongly deviate from a normal turn-taking behavior in quiet (what may indicative of a poor sound perception by the user), then the control unit 17 proceeds to a step 28.

Else (N), i.e. when the deviation $|TT-TT_{ref}|$ is found to be within the threshold $\Delta_{TT}$, then the negative result of the test is considered an indication to the fact that the user's turn-taking-behavior and, hence, his sound perception are sufficiently good. Accordingly, the control unit 17 decides not to take any actions and terminates the method in a step 30.

In order to verify the positive result of step 26, the control unit 17 tests in step 28 whether the deviation $F-F_{ref}$ of the pitch frequency F of the user's voice, as measured in step 22, from the reference value $F_{ref}$ exceeds a predetermined threshold $\Delta_F$ ($F-F_{ref}>\Delta_F$).

If above condition is found to be fulfilled (Y), i.e. if the pitch frequency F of the user is found to strongly deviate from a normal pitch frequency in quiet (being indicative of a negative emotional state of the user), then the control unit 17 proceeds to a step 32.

Else (N), i.e. when the deviation $F-F_{ref}$ is found to be within the threshold $\Delta_F$, then the negative result of the test is considered an indication to the fact that the unusual turn-taking-behavior, determined in step 26, is not correlated with a negative emotional state of the user. In this case, the unusual turn-taking-behavior will probably be caused by circumstances other that a poor sound perception by the user (for example, an apparent unusual turn-taking behavior that is not related to a poor sound perception may have been caused by the user speaking with himself while watching TV). Therefore, in case of a negative result of the test performed in step 28, the control unit 17 decides not to take any actions and terminates the method (step 30).

In order to further verify the positive results of steps 26 and 28, the control unit 17 tests in step 32 whether the sound level L of the captured sound signal, as measured in step 22 exceeds the predetermined threshold $L_T$ ($L>L_T$).

If above condition is found to be fulfilled (Y), i.e. if the sound level L found to exceed the threshold $L_T$ (being indicative of a difficult hearing situation), then the control unit 17 proceeds to a step 34.

Else (N), i.e. when the sound level L is found not to exceed the threshold $L_T$, then the negative result of the test is considered an indication to the fact that the unusual turn-taking-behavior, determined in step 26, and the negative emotional state of the user, as detected in step 28, is not correlated with a difficult hearing situation. In this case, the unusual turn-taking-behavior and the negative emotional state of the user will probably be caused by circumstances other that a poor sound perception by the user. For example, the user may be in a dispute the content of which causes the negative emotional state and, hence, the unusual turn-taking. Therefore, in case of a negative result of the test performed in step 32, the control unit 17 decides not to take any actions and terminates the method (step 30).

If all steps 26, 28 and 32 yield a positive result, i.e. if the tested criterion is fulfilled, then the control unit 17 decides to take predefined actions to improve the sound perception by the user.

To this end, in step 34, the control unit 17 informs the user, e.g. by a text message output via a display of the smartphone 4, that his sound perception is found to drop under usual, and suggests an automatic change of signal processing parameters of the hearing aid 2.

If the user confirms the suggestion, e.g. by touching an "OK" button created by the control unit 17 on display of the smartphone 4, then, in a step 36, the control unit 17 induces a predefined change of at least one signal processing parameter of the hearing aid 2 and terminates the method. E.g. the control unit 17 may:

a) enhance directionality of the processed sound signal, and/or b) enhance noise reduction during signal processing.

Preferably, the method according to steps 22 to 36 is repeated in regular time intervals or every time a new conversation is recognized.

Figure 2:
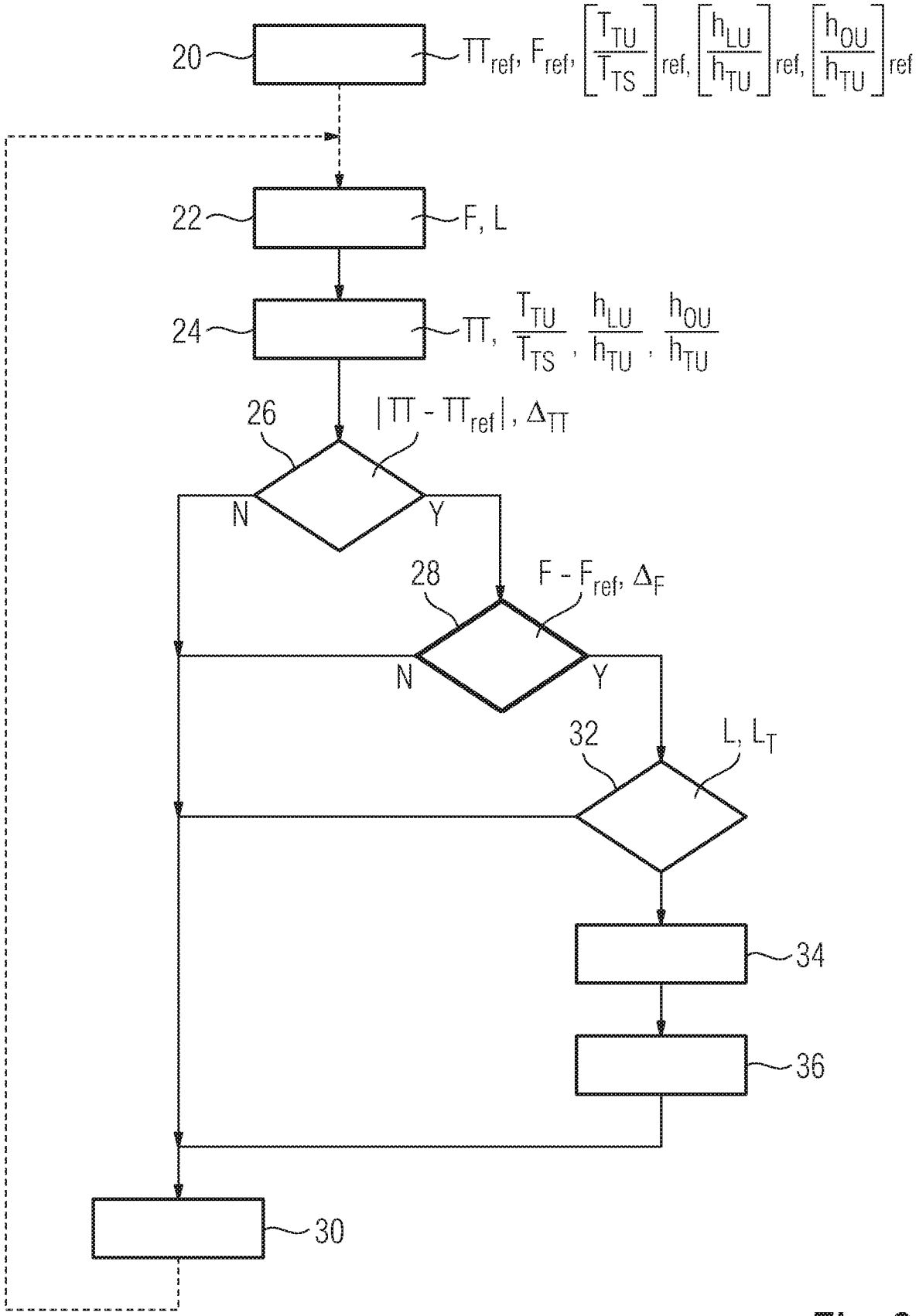
FIG. 2 is a flow chart showing a method for operating the hearing instrument of FIG. 1 according to the invention.
Figure 3:
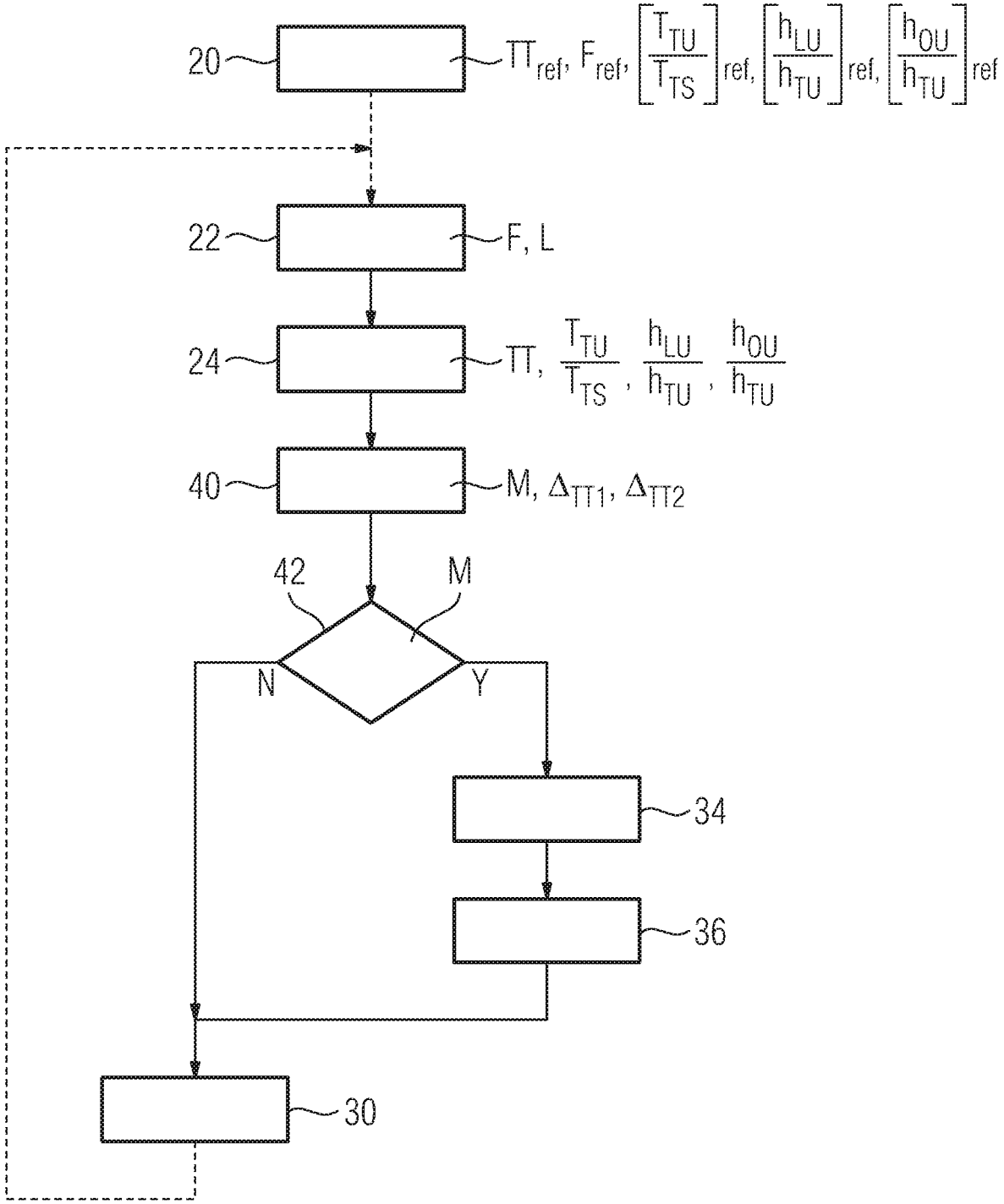
FIG. 3 is a flow chart of an alternative embodiment of the method for operating the hearing instrument.

In another example, the control unit 17 is configured to conduct a method according to FIG. 3. Steps 20 to 24 and 30 to 36 of this method resemble the same steps of the method shown in FIG. 2.

The method of FIG. 3 deviates from the method of FIG. 2 in that, in a step 40 (following step 24), the control unit 17 calculates a measure M of the sound perception by the user.

The measure M is configured as a variable that may assume one of three values "1" (indicating a good sound perception), "0" (indication a neutral sound perception) and "−1" (indicating a poor sound perception).

The value "1" (good sound perception) is assigned to the measure M, if:

a) the deviation $|TT-TT_{ref}|$ of the turn-taking behavior TT, as determined in step 24, from the reference value $TT_{ref}$ does not exceed a first threshold $\Delta_{TT1}$ ($|TT-TT_{ref}|\leq\Delta_{TT1}$); and b) the deviation $F-F_{ref}$ of the pitch frequency F of the user's voice, as measured in step 22, from the reference value $F_{ref}$ does not exceed the threshold $\Delta_F$ ($F-F_{ref}\leq\Delta_F$); and c) the sound level L of the captured sound signal, as measured in step 22, exceeds the threshold $L_T$ ($L>L_T$).

The value "−1" (poor sound perception) is assigned to the measure M, if:

a) the deviation $|TT-TT_{ref}|$ exceeds a second threshold $\Delta_{TT2}$ ($|TT-TT_{ref}|>\Delta_{TT2}$); and b) the deviation $F-F_{ref}$ exceeds the threshold $\Delta_F$ ($F-F_{ref}>\Delta_F$); and c) the sound level L of the captured sound signal, as measured in step 22 exceeds the threshold $L_T$ ($L>L_T$).

The value "0" (neutral sound perception) is assigned to the measure M in all other cases.

The thresholds $\Delta_{TT1}$ and $\Delta_{TT2}$ are selected so that the threshold $\Delta_{TT2}$ exceeds the threshold $\Delta_{TT1}$ ($\Delta_{TT2}>\Delta_{TT1}$).

The control unit 17 persistently stores the values of the measure M in the memory of the smartphone 4 as part of a data logging function. The stored values of the measure M are stored for a later evaluation by an audio care professional.

In a subsequent step 42, the control unit 17 tests whether the current value of the measure M correspond to −1 (M=−1).

If above condition is found to be fulfilled (Y), being indicative of a poor sound perception, then the control unit 17 proceeds to step 34. Else (N), i.e. if the measure M has a value of "0" or "1", then the control unit 17 decides not to take any actions and terminates the method in step 30.

It will be appreciated by persons skilled in the art that numerous variations and/or modifications may be made to the invention as shown in the specific examples without departing from the spirit and scope of the invention as broadly described in the claims. The present examples are, therefore, to be considered in all aspects as illustrative and not restrictive.

LIST OF REFERENCES

1 (hearing) system
2 hearing aid
3 hearing app
4 smartphone
5 microphones
7 receiver
9 battery
11 signal processor
12 voice recognition unit
13 voice detection module (VD module)
15 own voice detection module (OVD module)
16 wireless link
17 control unit
20 step
22 step
24 step
26 step
28 step
30 step
32 step
34 step
36 step
38 step
40 step
42 step
$T_{TU}/T_{TS}$ relation
$h_{LU}/h_{TU}$ relation
$h_{OU}/H_{TU}$ relation
$[T_{TU}/T_{TS}]_{ref}$ reference value
$[h_{LU}/h_{TU}]_{ref}$ reference value
$[h_{OU}/h_{TU}]_{ref}$ reference value
TT turn-taking behavior
$TT_{ref}$ reference value
F pitch frequency
L sound level
$F_{ref}$ reference value
$L_T$ threshold
$|TT-TT|_{ref}$ deviation
$\Delta_{TT}$ threshold
$F-F_{ref}$ deviation
$\Delta_F$ threshold
M measure
$\Delta_{TT1}$ threshold
$\Delta_{TT2}$ threshold

The invention claimed is:

1. A method for operating a hearing instrument being worn in or at an ear of a user, which comprises the following steps of:

capturing a sound signal from an environment of the hearing instrument;

analyzing the sound signal captured to recognize own-voice intervals, in which the user speaks, and foreign-voice intervals, in which at least one different speaker speaks;

determining, from the own-voice intervals and the foreign-voice intervals, at least one turn-taking feature, the at least one turn-taking feature taking into account a temporal length or a temporal occurrence of overlaps, wherein an overlap is an interval in which both the user and the different speaker speak and which exceeds a predefined threshold;

analyzing, during recognized own-voice intervals, the sound signal for at least one of a following acoustic features of an own voice of the user:

a voice level;

formant frequencies;

a pitch frequency;

a frequency distribution of the own voice; and a speed of speech;

analyzing the sound signal for at least one of a following environmental acoustic features:
a sound level of the sound signal;
a signal-to-noise ratio;

deriving a measure of sound perception by the user from a combination of:
the at least one turn-taking feature;
at least one of the acoustic features of the own voice of the user; and
at least one of the environmental acoustic features;

testing the measure of the sound perception with respect to a predefined criterion indicative of a poor sound perception; and taking a predefined action for improving the sound perception if the predefined criterion is fulfilled by automatically altering at least one parameter of a signal processing of the hearing instrument such that a noise reduction and/or a directionality are increased.

2. The method according to claim 1, wherein the measure of the sound perception is determined based on at least one of the following:
predetermined reference values of turn-taking features taken in quiet;
audiogram values representing a hearing ability of the user;
at least one uncomfortable level of the user; and
information concerning an environmental noise sensitivity and/or distractibility of the user.

3. The method according to claim 1, wherein the at least one turn-taking feature further takes into consideration at least one of:
a temporal length or a temporal occurrence of turns of the user and/or a temporal length or a temporal occurrence of turns of the different speaker, wherein a turn is a temporal interval in which the user or the different speaker speak without a pause, while a respective interlocutor is silent;
a temporal length or a temporal occurrence of pauses of the user and/or a temporal length or a temporal occurrence of pauses of the different speaker, wherein a pause is an interval without speech separating two consecutive turns of the user or two consecutive turns of the different speaker, the temporal length of which exceeds a predefined threshold;
a temporal length or a temporal occurrence of lapses, wherein a lapse is an interval without speech separating a turn of the different speaker and a consecutive turn of the user or between a turn of the user and a consecutive turn of the different speaker, the temporal length of which exceeds a predefined threshold;
a temporal occurrence of switches, wherein a switch is a transition from a turn of the different speaker to a consecutive turn of the user or from a turn of the user to a consecutive turn of the different speaker within a predefined time interval; and
a combination of a plurality of above mentioned features.

4. The method according to claim 1, wherein the predefined action for improving the sound perception further comprises automatically creating and outputting a feedback to the user by means of the hearing instrument and/or an electronic communication device linked with the hearing instrument for data exchange, the feedback indicating the poor sound perception and/or suggesting the user to visit an audio care professional.

5. The method according to claim 1, wherein the environmental acoustic features further include:
a reverberation time;
a number of different speakers; and
a direction of at least one of the different speakers.

6. A method for operating a hearing instrument that is worn in or at an ear of a user, which comprises the following steps of:
capturing a sound signal from an environment of the hearing instrument;
analyzing the sound signal captured to recognize own-voice intervals, in which the user speaks, and foreign-voice intervals, in which a different speaker speaks;
determining, from the own-voice intervals and the foreign-voice intervals, at least one turn-taking feature, the at least one turn-taking feature taking into account a temporal length or a temporal occurrence of overlaps, wherein an overlap is an interval in which both the user and the different speaker speak and which exceeds a predefined threshold;
analyzing, during recognized own-voice intervals, the sound signal for at least one of a following acoustic features of an own voice of the user:
a voice level;
formant frequencies;
a pitch frequency;
a frequency distribution of voice; and
a speed of speech;
analyzing the sound signal for at least one of a following environmental acoustic features:
a sound level of the sound signal captured; and
a signal-to-noise ratio;
testing the at least one turn-taking feature with respect to a predefined criterion indicative of a poor sound perception, wherein the predefined criterion is based on a combination of:
the at least one turn-taking feature;
at least one of the acoustic features of the own voice of the user; and
at least one of the environmental acoustic features; and
taking a predefined action for improving the poor sound perception if the predefined criterion is fulfilled, wherein the predefined action for improving the poor sound perception includes automatically altering at least one parameter of a signal processing of the hearing instrument such that noise reduction and/or a directionality are increased.

7. The method according to claim 6, wherein the predefined criterion further depends on at least one of a following:
predetermined reference values of turn-taking features taken in quiet;
audiogram values representing a hearing ability of the user;
at least one uncomfortable level of the user; and
information concerning an environmental noise sensitivity and/or distractibility of the user.

8. The method according to claim 6, wherein the at least one turn-taking feature further takes into consideration at least one of:
a temporal length or a temporal occurrence of turns of the user and/or a temporal length or a temporal occurrence of turns of the different speaker, wherein a turn is a temporal interval in which the user or the different speaker speak without a pause, while a respective interlocutor is silent;

a temporal length or a temporal occurrence of pauses of the user and/or a temporal length or a temporal occurrence of pauses of the different speaker, wherein a pause is an interval without speech separating two consecutive turns of the user or two consecutive turns of the different speaker, the temporal length of which exceeds a predefined threshold;

a temporal length or a temporal occurrence of lapses, wherein a lapse is an interval without speech separating a turn of the different speaker and a consecutive turn of the user or between a turn of the user and a consecutive turn of the different speaker, the temporal length of which exceeds a predefined threshold;

the temporal occurrence of switches, wherein a switch is a transition from a turn of the different speaker to a consecutive turn of the user or from a turn of the user to a consecutive turn of the different speaker within a predefined time interval; and a combination of a plurality of above mentioned features.

9. The method according to claim 6, wherein the predefined action for improving the poor sound perception further comprises automatically creating and outputting a feedback to the user by means of the hearing instrument and/or an electronic communication device linked with the hearing instrument for data exchange, the feedback indicating the poor sound perception and/or suggesting the user to visit an audio care professional.

10. A hearing system, comprising:

a hearing instrument to be worn in or at an ear of a user, said hearing instrument containing:

an input transducer disposed to capture a sound signal from an environment of said hearing instrument;

a signal processor disposed to process the sound signal;

an output transducer disposed to emit a processed sound signal into the ear of the user;

a voice recognition unit configured to analyze the sound signal to recognize own-voice intervals, in which the user speaks, and foreign-voice intervals, in which a different speaker speaks; and a controller configured to determine, from the own-voice intervals and the foreign-voice intervals, at least one turn-taking feature, the at least one turn-taking feature taking into account a temporal length or a temporal occurrence of overlaps, wherein an overlap is an interval in which both the user and the different speaker speak and which exceeds a predefined threshold;

said signal processor configured to:

analyze the sound signal captured, during the own-voice intervals, for at least one of a following acoustic features of an own voice of the user:

a voice level;

formant frequencies;

a pitch frequency;

a frequency distribution; and a speed of speech;

analyze the sound signal captured for at least one of a following environmental acoustic features:

a sound level of the sound signal; and a signal-to-noise ratio;

said controller further configured to:

derive a measure of a sound perception by the user from a combination of:

the at least one turn-taking feature;

at least one of the acoustic features of the own voice of the user; and at least one of the environmental acoustic features;

test the measure of the sound perception with respect to a predefined criterion indicative of a poor sound perception; and take a predefined action for improving the sound perception if the predefined criterion is fulfilled by automatically altering at least one parameter of a signal processing of said hearing instrument such that noise reduction and/or a directionality are increased.

11. The hearing system according to claim 10, wherein said controller is configured to determine the measure of the sound perception based on at least one of a following:

predetermined reference values of turn-taking features taken in quiet;

audiogram values representing a hearing ability of the user;

at least one uncomfortable level of the user; and information concerning an environmental noise sensitivity and/or distractibility of the user.

12. The hearing system according to claim 10, wherein the at least one turn-taking feature takes into consideration at least one of:

a temporal length or a temporal occurrence of turns of the user and/or a temporal length or a temporal occurrence of turns of the different speaker, wherein a turn is a temporal interval in which the user or the different speaker speak without a pause, while a respective interlocutor is silent;

a temporal length or a temporal occurrence of pauses of the user and/or a temporal length or a temporal occurrence of pauses of the different speaker, wherein a pause is an interval without speech separating two consecutive turns of the user or two consecutive turns of the different speaker, the temporal length of which exceeds a predefined threshold;

a temporal length or a temporal occurrence of lapses, wherein a lapse is an interval without speech separating a turn of the different speaker and a consecutive turn of the user or between a turn of the user and a consecutive turn of the different speaker, the temporal length of which exceeds a predefined threshold;

a temporal occurrence of switches, wherein a switch is a transition from a turn of the different speaker to a consecutive turn of the user or from a turn of the user to a consecutive turn of the different speaker within a predefined time interval; and a combination of a plurality of above mentioned features.

13. The method according to claim 10, wherein the predefined action for improving the sound perception further comprising automatically creating and outputting a feedback to the user by means of said hearing instrument and/or an electronic communication device linked with said hearing instrument for data exchange, the feedback indicating a poor sound perception and/or suggesting the user to visit an audio care professional.

14. A hearing system, comprising:

a hearing instrument worn in or at an ear of a user, said hearing instrument containing:

an input transducer disposed to capture a sound signal from an environment of said hearing instrument;

a signal processor disposed to process the sound signal captured; and an output transducer disposed to emit a processed sound signal into the ear of the user;

a voice recognition unit configured to analyze the sound signal to recognize own-voice intervals, in which the user speaks, and foreign-voice intervals, in which a different speaker speaks; and a controller configured to determine, from the own-voice intervals and the foreign-voice intervals, at least one turn-taking feature, the at least one turn-taking feature taking into account a temporal length or a temporal occurrence of overlaps, wherein an overlap is an interval in which both the user and the different speaker speak and which exceeds a predefined threshold;

said signal processor is configured to:

analyze, during recognized own-voice intervals, the sound signal for at least one of a following acoustic features of an own voice of the user:

a voice level;

formant frequencies;

a pitch frequency;

a frequency distribution; and a speed of speech;

analyze the sound signal for at least one of a following environmental acoustic features:

a sound level of the sound signal; and a signal-to-noise ratio;

wherein said controller configured to:

test the at least one turn-taking feature with respect to a predefined criterion indicative of a poor sound perception, wherein the predefined criterion is based on a combination of:

the at least one turn-taking feature;

at least one of the acoustic features of the own voice of the user; and at least one of the environmental acoustic features; and take a predefined action for improving the poor sound perception if the predefined criterion is fulfilled, by automatically altering at least one parameter of a signal processing of said hearing instrument such that noise reduction and/or a directionality are increased.

15. The hearing system according to claim 14, wherein the predefined criterion further depends on at least one of a following:

predetermined reference values of turn-taking features taken in quiet;

audiogram values representing a hearing ability of the user;

at least one uncomfortable level of the user; and information concerning an environmental noise sensitivity and/or distractibility of the user.

16. The hearing system according to claim 14, wherein the at least one turn-taking feature further takes into account at least one of:

a temporal length or a temporal occurrence of turns of the user and/or a temporal length or a temporal occurrence of turns of the different speaker, wherein a turn is a temporal interval in which the user or the different speaker speak without a pause, while a respective interlocutor is silent;

a temporal length or a temporal occurrence of pauses of the user and/or a temporal length or a temporal occurrence of pauses of the different speaker, wherein a pause is an interval without speech separating two consecutive turns of the user or two consecutive turns of the different speaker, the temporal length of which exceeds a predefined threshold;

a temporal length or a temporal occurrence of lapses, wherein a lapse is an interval without speech separating a turn of the different speaker and a consecutive turn of the user or between a turn of the user and a consecutive turn of the different speaker, the temporal length of which exceeds a predefined threshold;

a temporal occurrence of switches, wherein a switch is a transition from a turn of the different speaker to a consecutive turn of the user or from a turn of the user to a consecutive turn of the different speaker within a predefined time interval; and a combination of a plurality of above mentioned features.

17. The hearing system according to claim 14, wherein the predefined action for improving the sound perception further comprising automatically creating and outputting a feedback to the user by means of said hearing instrument and/or an electronic communication device linked with said hearing instrument for data exchange, the feedback indicating the poor sound perception and/or suggesting the user to visit an audio care professional.

* * * * *